US005354081A

United States Patent [19]

Huffman et al.

[11] Patent Number: 5,354,081

[45] Date of Patent: Oct. 11, 1994

[54] STUNT RIDING TOY

[75] Inventors: Michael L. Huffman; Michael D. Commerford, both of Jefferson County, Mo.

[73] Assignee: High Tech Toys, Inc., Festus, Mo.

[21] Appl. No.: 11,214

[22] Filed: Jan. 29, 1993

Related U.S. Application Data

[63] Continuation-in-part of Ser. No. 702,711, May 20, 1991, Pat. No. Des. 332,977.

[51] Int. Cl.[5] ..... B62B 19/04

[52] U.S. Cl. ..... 280/87.01; 280/87.021; 280/87.03; 280/7.14; D21/71

[58] Field of Search ..... 280/21.1, 22, 28.11, 280/28.14, 28.15, 28.16, 87.041, 87.01, 87.021, 87.03, 87.043; D21/71, 81

[56] References Cited

U.S. PATENT DOCUMENTS

| | | | |
|---|---|---|---|
| D. 84,828 | 8/1931 | Gill | D21/71 |
| 4,098,519 | 7/1978 | Reid, Jr. | 280/87.01 |
| 4,134,599 | 1/1979 | DiMille et al. | 280/87.01 |
| 4,323,258 | 4/1982 | Culpeper | 280/87.01 |
| 4,336,952 | 6/1982 | Rochman | 280/87.01 |
| 4,384,731 | 5/1983 | Webb | 280/87.01 |

*Primary Examiner*—Richard M. Camby
*Attorney, Agent, or Firm*—Paul M. Denk

[57] ABSTRACT

A stunt riding toy that may be used upon a roadway surface, or a snow packed hill, incorporating wheels or skiis, provided at opposite ends of an elongated structure, and which is tiltable to either side, due to the narrow center of gravity provided along the length of the device, further incorporating hand gripping elements upon laterally extending bars for holding with the hands, during movement, and having outboard tilt wheels or skiis that limit the extent of inclination to the device, laterally, during usage, but yet afford adequate control to allow turning as when moving around a curve during high speed downhill travel. Braking devices are provided primarily at the rear of the device, but in addition, incorporating a footrest that may contact the ground, to afford supplemental brakage, when such becomes necessary, to either slow down or stop the device from accelerated downhill movement.

11 Claims, 4 Drawing Sheets

STUNT RIDING TOY

CROSS-REFERENCE TO RELATED APPLICATION

This application comprises a continuation-in-part of, and is related to, the design patent application filed by the same inventors upon the invention entitled "Stunt Riding Toy," filed in the U.S. Patent Office on May 20, 1991, under Ser. No. 07/702,711, now U.S. Pat. No. D.332,977, both of said applications being owned by a common assignee.

BACKGROUND OF THE INVENTION

This invention relates generally to a stunt riding toy, and more specifically to a riding toy that can attain rapid speeds and provide for downhill movement upon either a roadway-like surface, or down an incline impacted with snow.

A variety of riding toys have long been available in the art. For example, the well-known "Big Wheel," was in vogue a dozen years ago, and provided for riding by the youth over the roadway surface, generally through pedal movement, but also attaining some speed when the wheeled vehicle was driven downhill on a street, roadway, or the like.

Various other patents disclose related embodiments for providing movement over a surface. For example, the patent to Hegel, No. 1,052,722, and which discloses a form of coasting device, shows the use of a relatively narrow support, for holding the rider, having a pair of roller type means applied thereunder, generally at the vicinity where the rider sits, to provide forward movement when motivated by a rod. Breaking was attained by the rider through undertaking a forward tilt.

The patent to Thomas, U.S. Pat. No. 1,327,123, discloses another form of coaster, with the applicability of this shown device utilizing single rollers, provided along the length of the device, and with a hand holding means furnished through notches proximate the sides of its seating surface.

The patent to Cushing, et al, U.S. Pat. No. 1,510,585, shows another form of hand propelling means for a scooter. As can be seen, the scooter incorporates a length of board, has a cushion thereon, with a shallow backrest, and incorporates a footrest, set forth upon the cross-bar as noted, at the forward end of the board. The device incorporates a single pair of rollers, at both the front and rear of the device.

The patent to Hendricks, U.S. Pat. No. 3,663,038, discloses a vehicle with combination steering, braking, and propulsion means. This device is fairly complex, both in appearance and operation, and incorporates its own integral seat, as noted, to provide a variety of maneuvers as the device moves upon its shown wheels.

The design patent Rose, U.S. Pat. Des. No. 246,198, is also upon a form of coaster, and once again, discloses a form of board means, with wheels at the front and back, and a back rest, as noted.

The patent to Sullivan, U.S. Pat. No. 4,166,630, shows a child's propelled riding toy. This particular device apparently is for use for kneeling, as noted, and incorporates a lateral support arm, with a roller assembly attached thereto, in order to prevent its overturning.

The patent to Culpeper, U.S. Pat. No. 4,323,258, shows a form of convertible coaster having runners or wheels, and which appears to be fabricated in the shape of an airplane, for riding purposes. The operator obviously sits upon the removable seat, and locates his feet upon the shown pedals, for either braking or guidance.

The patent to Samuelson, U.S. Pat. No. 4,323,261, discloses another form of skateboard device, having a frame mounted on it, apparently for safety purposes, since the specification describes that older persons and the physically handicapped may ride upon this develoment.

The patent Mulcahy, U.S. Pat. No. 4,359,231, discloses a steering mechanism for another type of three-wheeled vehicle. This device functions somewhat like the "Big Wheel," having larger wheels laterally spaced at the back, and a front wheel, as noted.

The patent to Webb, U.S. Pat. No. 4,384,731, shows a reclinable skate board. This device uses a wider type of skateboard, with a spring type backrest, at the back, and has custom designed footrests at its front.

The patent to Dowton, U.S. Pat. No. 4,761,013, shows another type of propelled vehicle, which apparently is manipulated by means of the feet resting upon a plate, and which when manipulated and pivoted, provides for movement and direction for the vehicle.

The patent to Hawkes, U.S. Pat. Des. No. 302,994, discloses a form of balanced skateboard scooter. This device apparently is made of a molded polymer, to incorporate integral type wings, within its structure. It does locate supplemental wheels, up upon and laterally under the shown wings, which apparently contact the ground, when tilting or movement around curvature occurs.

Finally, the patent to Zatlin, U.S. Pat. No. 4,887,824, shows a skatecraft. This particular device utilizes a form of curved platform, which has skate means or wheels at the front and back, in addition to supplemental or lateral wheels upon the upper sides. These wheels are designed for contacting the surface, when the skateboard enters a curved path of movement, or tilts.

SUMMARY OF THE INVENTION

It is the principal object of this invention to provide an elongated stunt riding toy, formed in the configuration of a length of structural means, conveniently maneuvered through wheels, and which has lateral support to provide for tilting of the rider or occupant during usage, to add to the dexterity of application of the device, particularly when encountering high speeds upon a downhill ride.

This invention contemplates the formation of a stunt riding toy, or a riding toy in general, incorporating a length of structural means, and having a pair of motivating means, whether it be shock absorber mounted wheels, or skiis, at both the front and back of the means, to facilitate rapid movement of the occupant or rider over a surface, whether it be a roadway, ramp, or snow. The invention includes various means for facilitating the carrying of the rider, such as a footrest at the front, and which footrest may be pivotally mounted so as to engage the ground, to supplement the braking action to the device. The rear wheels or back skiis cooperate, also, with brake means, to facilite the main stopage of the toy, during its usage and application, and particularly after a speedy downhill ride or race has been completed, and for safety purposes, prompt stoppage is required. Since the device is fabricated with a seat upon the elongated structural means, and the device, because of its design, incorporates cushioned means for mounting of its various wheels and skiis, that can tilt laterally, the device further incorporates laterally extending handle means, to facilitate the grip and support of the occupant, and also provides outbound means for contacting the surface upon which the toy rides, whether it be in the form of wheels, or skiis, to prevent a too far of tilt to the side when the rider encounters, as for example, a curve, or turn, during high speed downhill movement. In addition, the brake means are conveniently, generally, operatively associated with the lateral hand gripping means, and comprises a hand brake, having connected cable to the brake means operatively associated with the rearward portion of the elongated structural means, and can engage the wheels, when the brake is applied, to slow or curtail further movement, or the brake means may engage the ground, to provide stoppage, particularly when the device is mounted upon skiis, for downhill skiing upon snow.

It is, therefore, the principal object of this invention to provide a downhill stunt riding toy that may be used upon a roadway surface, or ramp, or even applied upon snow, to provide a fast moving downhill ride for its occupant.

Another object of this invention is to provide means for preventing any excessive tilting of the toy particularly when manuevered around a turn or curve.

Another object of this invention is to provide the convenient location of brake means, to facilitate a slow down or stoppage to the toy, when such is required.

Another function of this invention is to apply a footrest at the front of the toy, and upon which the feet of the occupant may rest, during downhill movement, but which footrest may further be manipulated into engagement with the surface upon which the toy rides, particularly snow, to facilitate its gradual slow down.

Another object of this invention is to provide a stunt riding toy incorporating skiis, and which may be fabricated from noncorrosive materials, to facilitate the long term usage and application of this device even during continuous inclement weather conditions.

Yet another object of this invention is to provide a stunt riding toy incorporating wheels or skiis that are cushioned mounted, such as through shock absorbing means, in order to accommodate some degree of tilt to the occupant, when riding upon the structure, to allow the rider to motivate some degree of turn to the toy even during a high speed downhill ride.

These and other objects may become more apparent to those skilled in the art upon reviewing this summary of the invention, and upon undertaking a study of the description of its preferred embodiment, in view of the drawings.

DESCRIPTION OF THE PREFERRED EMBODIMENT

Figure 1:
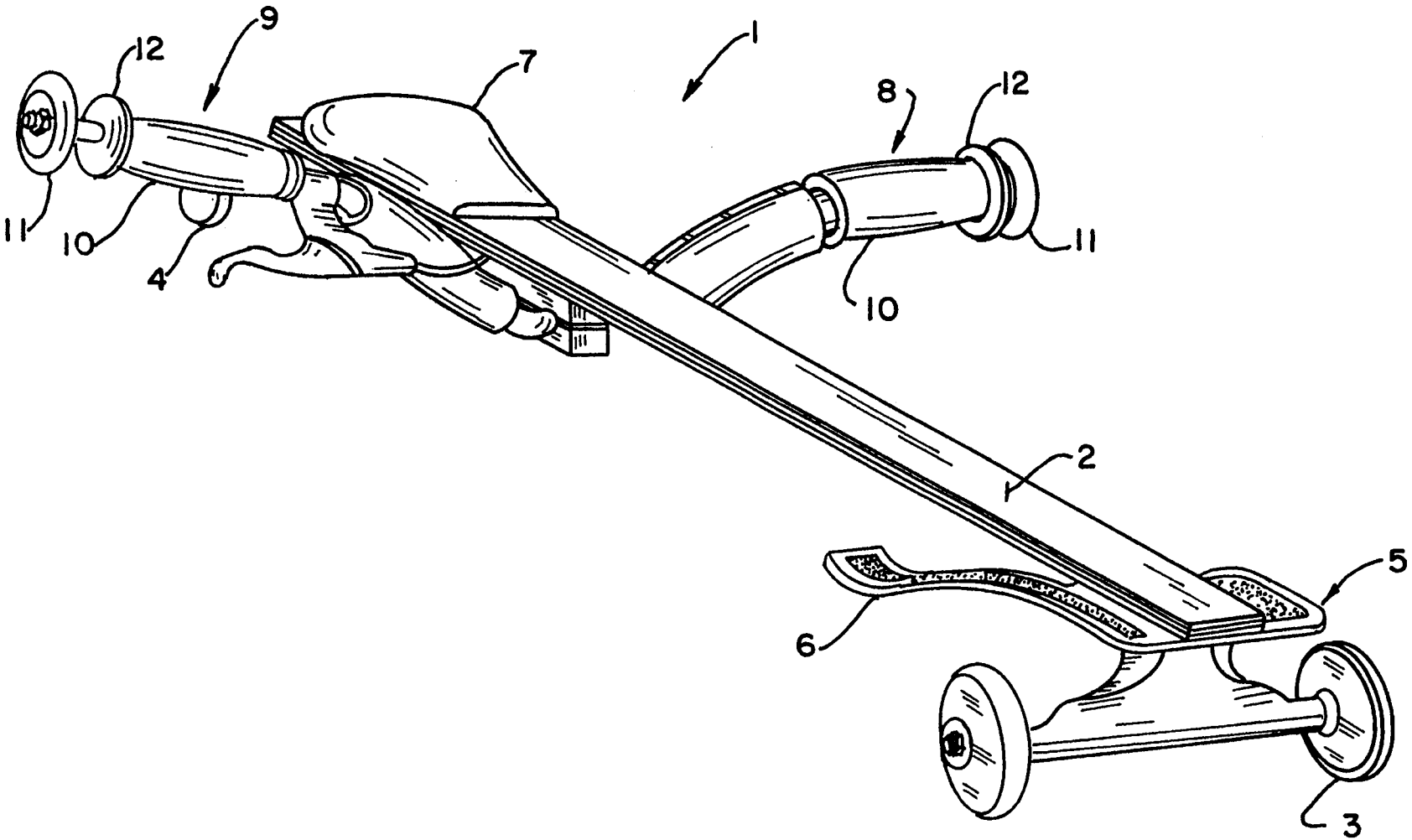
FIG. 1 is an isometric view of the stunt riding toy of this invention.
Figure 2:
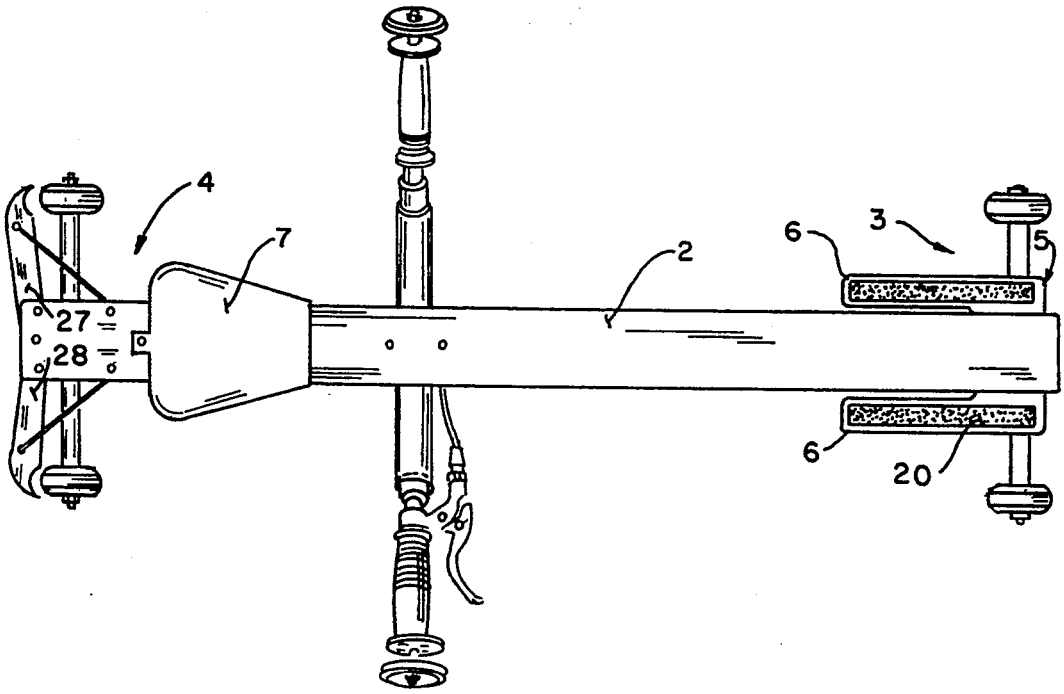
FIG. 2 is a plan view thereof.
Figure 3:
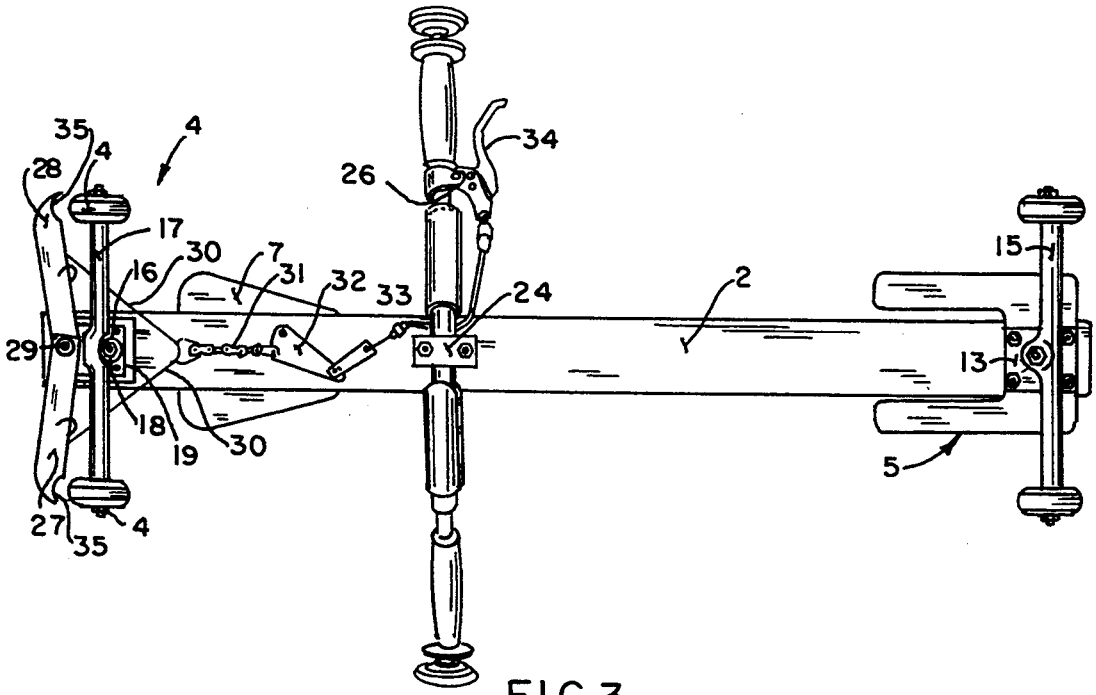
FIG. 3 is a bottom view thereof.

In referring to FIG. 1 of the drawings, there is disclosed the stunt riding toy 1 of this invention. As shown, it includes a length of structural means 2, comprising an elongated rod or flat stock, or which may be fabricated from any noncorrosive metal, polymer, wood, or the like. At the front and back ends of the device are located, in this particular instance, wheeled means 3 and 4, useful for facilitating the rapid movement of this riding vehicle over a surface, such as a roadway, particularly when maneuvering in a downhill movement. Further extending rearwardly from the underside of the front of the structural means is a footrest, as at 5, and which provides a pair of footresting segments, as shown at 6, which incline slightly downwardly, and rearwardly, to facilitate the convenient resting of the feet of the operator thereon, when undertaking a downhill ride. In addition, means are provided for stabilizing the emplacement of the rider upon the toy, and as can be seen, a contoured seat 7 is provided proximate the rear of the device. In addition, slightly forwardly thereof, a pair of hand gripping means, as at 8 and 9 , extend laterally, respectively, from the left and right sides of the toy, and each has a hand grip, as at 10, provided thereon. Furthermore, and due to the fact that tilting of this vehicle may occur when the rider rides upon it, particularly when encountering a curve or turn, means are provided at the outer ends of the hand gripping means, such as the minature wheels 11, as shown, and which may engage the ground, in the event that too far of a tilt is undertaken, in order to stabilize the rider upon the vehicle, during rapid descending movement.

As can further be seen, outwardly of the hand grips 10 are hand stops 12, which prevent the hand of the rider from slipping outwardly, and contacting the wheels 11, when momentum may cause a tilt to one side, and there may be a tendency for the rider to shift in that direction, because of the slant undertaken and the momentum occurring.

As can be seen in FIGS. 2 through 7, the stunt riding toy of FIG. 1 is disclosed in greater detail. As shown, the structural means or elongated member 2, has the wheels 3 and 4 generally mounted to the underside thereof, and in their mounting the wheels are supported by cushioned wheel mounts, as at 13 and 14, which function not only as shock absorbers to cushion the ride upon the vehicle, but likewise, allow some degree of tilting and canting to occur to the wheels, particularly when a curve is encountered. Mounts of this type normally include a form of grommet, fabricated of rubber or a resilient polymer, and which mount the axle 15, as shown at the front, to the support 13, in order to afford that degree of tilt as desired. A similar type of mount is provided for the rear wheels 4, as can be noted at 16. The rear axle 17 connects through the axle bolt 18 to the base support 19 in the connection of the rear wheels 4 to the structural means 2 of the vehicle.

In addition, the footrest 5, includes its rearwardly extending foot cradling portions 6, as can be noted, and some degree of abrasive means 20, such as an abrasive surface incorporating a pressure sensitive tape, as noted, may be applied thereon, in order to assure retention of the shoe on the foot support, and to prevent their untimely release, as when high speed downhill movement may be undertaken.

Figure 4:
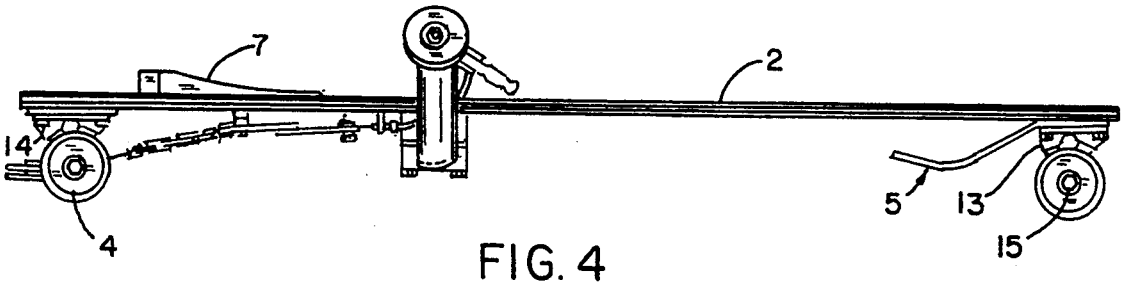
FIG. 4 is a left side view thereof.
Figure 5:
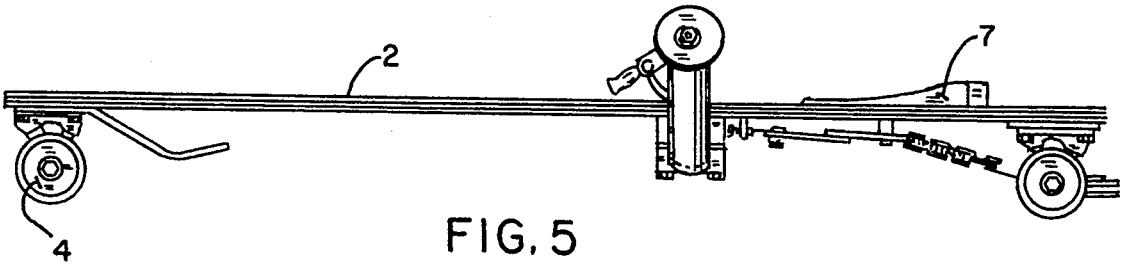
FIG. 5 is a right side view thereof.

In addition to the foregoing, it is just as likely that the foot support 5 could likewise be pivotally mounted, either by means of grommets, or perhaps supported by means of a pivot means, normally biased upwardly into its foot supporting position as shown in FIG. 4, but that when excessive foot pressure is applied, the footrest 5 will pivot downwardly, and its rearward under surface will engage the ground, or the surface of the snow, when used in that instance, in order to provide for a slow down or braking of further movement, for the vehicle, during usage.

Figure 6:
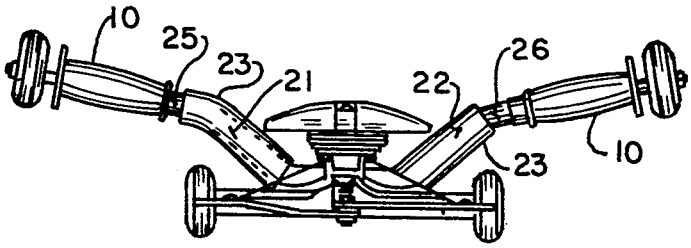
FIG. 6 is a rear view thereof.
Figure 7:
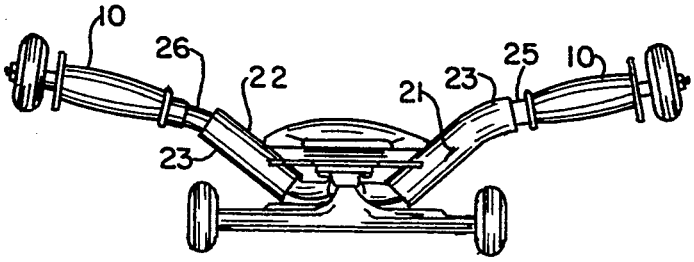
FIG. 7 is a front view thereof.

As can further be seen in FIGS. 6 and 7, the handle gripping means extends upwardly, in a first segment, at a greater angle with the ground, as can be noted at 21 and 22, and include a cushioned means provided thereon, as at 23, for shielding the occupant from any injury, in the event that he/she should be impacted against it. And, as can further be seen in FIG. 3, the handle gripping means extends from underneath of the elongated structure 2, and is clamped into position by means of the clamping means 24. The outbound portions of the hand gripping means, as at 25 and 26, extend at a more horizontal angle, and have the hand gripping elements 10 applied thereto, as noted. The means 24 can be loosened, to allow the hand gripping means to be repositioned forwardly or rearwardly, to the convenience of the rider.

The primary braking means utilized in conjunction with this stunt riding toy includes a pair of pivotal brake levers, and which pivotally mount to the underside of the back end of the structural means 2, by means of a pinned connection, as at 29. These brake levers may be spring biased rearwardly, to keep them out of contact with the wheels 4 of the vehicle. But, the braking means further includes the cable 30, linked together by a linkage mechanism 31, and having a pivot plate 32 connecting with the cable 33 that extends from the hand brake 34, which mounts to the one handle means 26, as noted. Thus, actuation of the brake hande 34, pivots the plate 32, which pulls the brake cables 30, for applying the brakes 27 and 28 at their braking surfaces 35, to engage the wheels 4, and slow down or curtail further movements of the stunt riding toy.

Figure 8:
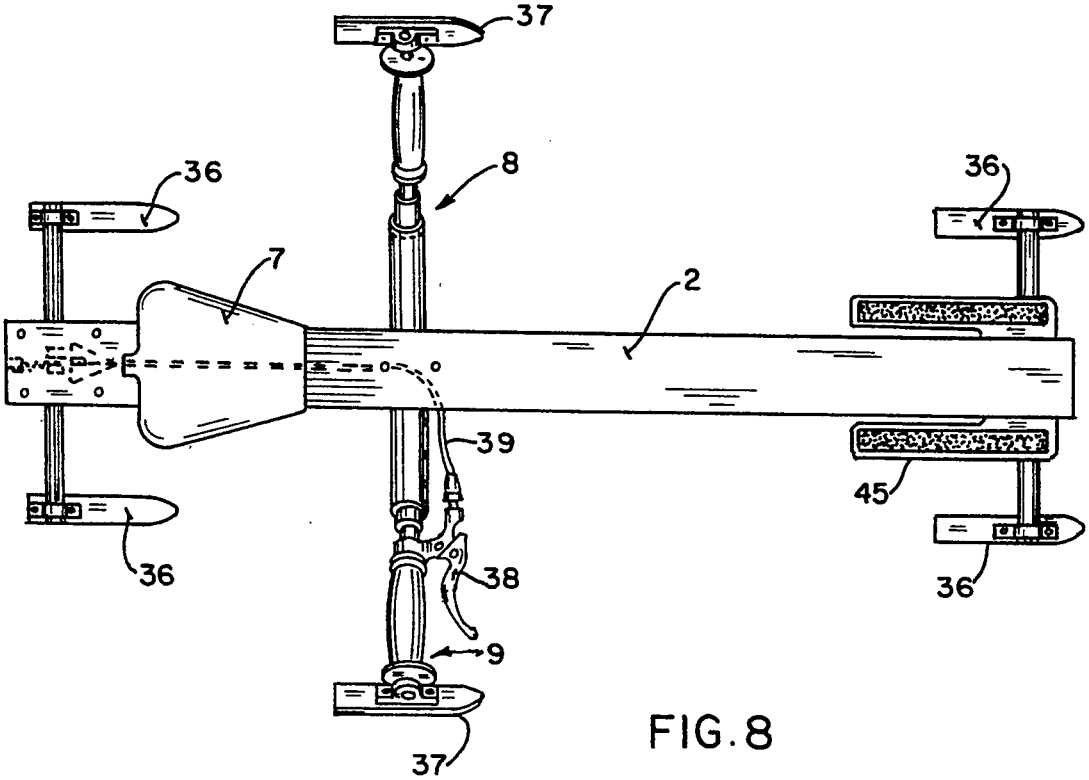
FIG. 8 is a top plan view of a modification to the stunt riding toy incorporating skiis as the means for maneuvering over a surface, such as snow.
Figure 9:
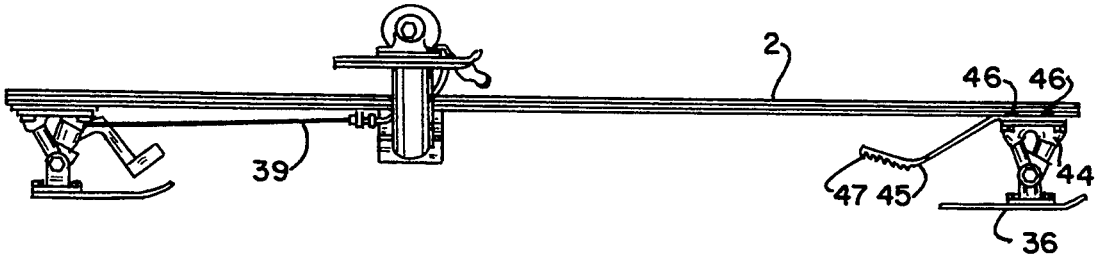
FIG. 9 is a left side view thereof.
Figure 10:
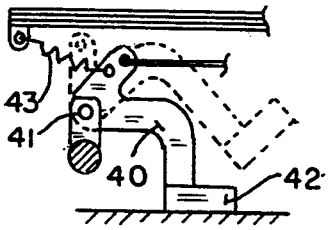
FIG. 10 provides a partial view of the toy of FIG. 8, showing its rear mounted brake means in operation, and in phantom line, when maintained inoperative.

As can also be seen in FIGS. 8 through 10, a modification to the invention as shown, and in this particular instance, the structural components are similarly related to that as previously described. But, as noted, the toy is designed for riding upon a surface of snow, to add to the dexterity of usage of this particular device. The structural means 2 with its seat 7 is identical to that as previously described, the laterally extending handle means 8 and 9 are similarly constructed, but in this particular instance, the primary wheels as previously explained, have been replaced by skiis, as noted at 36. In addition, the laterally disposed means for contacting the surface of the snow, which previously in the earlier defined embodiment comprised the wheels 11, or likewise replaced with skiis 37. Thus, when tilting occurs to the device, the lateral skiis 37 will contact the snow surface, and prevent the extent to which a lateral incline may occur to the toy during usage, in a manner as previously reviewed.

In addition to the foregoing, the brake means is generally constructed similarly to that as previously described, incorporating its brake handle 38, its cable 39, but in this particular instance, the cable 39 engages a spring biased lever 40, which when pulled, creates a pivot about the axle pivot 41, causing the brake, at its pad location 42, to contact the surface of the ground, and prevent or slow down the speed of movement to the vehicle. The spring 43, when the brake is released, pivots the brake lever 40 into a surface disengagement, to prevent further braking. In addition to the foregoing, and as previously explained, the front ski 36, as noted in FIG. 9, may be mounted by grommets to its support 44, and likewise, further secures the foot supporting member 45 at a position beneath the structural means 2. But, the further mounting of the supporting member 44, and the foot support 45, by means of grommets, or pivot means, as at 46, may allow for the downward pivot to the foot supporting means 45, and allow its engagement with the ground, wherein its serrated lower edge 47 may contact and engage the snow surface, to provide further braking for the device, when a slow down is required.

In any event, the structure of this particular device, as described herein, defines a stunt riding toy of the type that may be driven over a road surface, as in the first embodiment, or utilized upon a snow surface, as in the second embodiment, having built-in safety features so as to prevent a tip-over of the device during its usage, affords adequate braking when necessary, all to the safety of usage of this device, but yet furnishes a high speed vehicle that when driven downhill, or down a snow surface, can move at high speeds, and curve or turn depending upon the shift in the body movements of the operator, as desired, to add to the dexterity of usage of this particular device when moved.

Variations or modifications to the subject matter of this invention may occur to those skilled in the art upon reviewing the disclosure provided herein. Such variations, if within the spirit of this invention, are intended to be encompassed within the scope of any claims to patent protection issuing upon this device. The description of the preferred embodiment set forth herein is done so for illustrative purposes only.

Having thus described the invention, what is claimed and desired to be secured by Letters Patent is:

1. A stunt riding toy, for use by a rider in providing downhill movement over a surface, comprising an elongated structural means extending for a length sufficient to accommodate the emplacement of the rider thereon, movement means provided at opposite ends of the structural means and allowing for movement of the stunt riding toy over a surface, seat means provided upon the structural means at a location rearwardly thereof, and provided for accommodating the sitting of the rider thereon, hand gripping means extending laterally from each side of the structural means, said hand gripping means disposed in proximity just forwardly of the seat means, and positioned to provide for grasping of the hand gripping means by the rider at both sides of the toy thereof, foot emplacement means provided at the frontal end of the structural means and allowing for emplacement of the feet of the rider thereat, said hand gripping means having surface contacting means provided at the outer ends thereof, and useful for riding upon the surface due to tilting of the stunt riding toy during movement, brake means operatively associated with the structural means and providing for braking action in the movement of the toy during downhill riding, said movement means comprising wheel means structurally connecting to the structural means at opposite ends thereof, and disposed for rolling engagement over a surface during a downhill ride, said surface contacting means of the hand gripping means comprising further wheel means provided at the outer ends of each of the hand gripping means, said further wheel means disposed for contacting the ground and rolling thereon to prevent further tilting of the stunt riding toy during a downhill ride.

2. The invention of claim 1 wherein said movement means comprising wheel means structurally connecting to the structural means at opposite ends thereof, and disposed for rolling engagement over the surface during a downhill ride.

3. The invention of claim 2 and including wheel means provided at the outer ends of each of the handle means, said wheel means disposed for contacting the ground and rolling thereon to prevent further tilting of the stunt riding toy during a downhill ride.

4. The invention of claim 3 wherein said brake means operatively associated with the handle means, said brake means comprising a hand grip brake means, brakes operatively associated with the rear wheel means to engage the wheels and provide braking action, upon manipulation of the hand braking means, to provide for a slow down or stopping of the stunt riding toy during a downhill ride.

5. The invention of claim 4 wherein said brake means comprising a pair of pivotal levers, said pivotal levers having wheel engaging surfaces provided at their outer ends, cable means interconnecting between the hand braking means and the pivotal levers whereby upon actuation of the hand braking means, the levers are pivoted into engagement with the wheels to provide for braking action.

6. The invention of claim 3 wherein said hand gripping means connecting to the underside of the structural means of the stunt riding toy.

7. The invention of claim 6 wherein the foot resting means connecting to the underside at the front of the structural means of the stunt riding toy.

8. The invention of claim 7 wherein said foot resting means having a pair of integrally formed and rearwardly extending downwardly slanting pads, said pads being disposed for accommodating the convenient resting of the feet of the rider thereon during a downhill ride.

9. The invention of claim 6 wherein said hand gripping means having outer shields, interconnecting with the hand gripping means, slightly inwardly of the surface engaging means, to prevent slippage of the hands outwardly of the hand gripping means during a downhill ride.

10. The invention of claim 1 wherein said seat means structurally connecting to the upper surface of the structural means.

11. The invention of claim 8 wherein said foot resting means operatively associated with the front of the structural means being pivotally mounted, and biased upwardly which when forced downwardly against their upward bias engaging the ground to provide further braking action to the stunt riding toy during a downhill ride.

* * * * *